US009668317B2

(12) United States Patent
LeSaffre

(10) Patent No.: US 9,668,317 B2
(45) Date of Patent: May 30, 2017

(54) DEVICE AND METHOD FOR DETECTING A SHORT-CIRCUITED LIGHT-EMITTING DIODE IN A LIGHT DEVICE OF A MOTOR VEHICLE

(71) Applicant: Valeo Vision, Bobigny (FR)

(72) Inventor: Olivier-Sebastien LeSaffre, Pantin (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 15/140,960

(22) Filed: Apr. 28, 2016

(65) Prior Publication Data

US 2017/0006671 A1 Jan. 5, 2017

(30) Foreign Application Priority Data

Apr. 29, 2015 (FR) ..... 15 53888

(51) Int. Cl.
*H05B 33/08* (2006.01)

(52) U.S. Cl.
CPC ..... *H05B 33/089* (2013.01)

(58) Field of Classification Search
CPC H05B 37/02; H05B 37/0272; H05B 37/0227; H05B 33/0809; H05B 37/029; H05B 33/0845; H05B 37/0218; H05B 33/0854; H05B 37/034; H05B 37/03; H05B 33/0803; H05B 33/0815; H05B 37/00; H05B 37/0254
See application file for complete search history.

(56) References Cited

U.S. PATENT DOCUMENTS 7,638,947 B2 12/2009 Ito et al.
8,575,839 B2 11/2013 Inoue et al.
2012/0098430 A1 4/2012 Inoue et al.

FOREIGN PATENT DOCUMENTS

DE 102007024784 A1 11/2008

*Primary Examiner* — Monica C King
(74) *Attorney, Agent, or Firm* — Jacox, Meckstroth & Jenkins

(57) ABSTRACT

A light device that makes it possible to detect a short-circuited light-emitting diode in a series assembly of a plurality of such diodes. By taking into account the junction temperature of the diodes, the device and the method associated therewith make it possible to avoid false positive short-circuit detections. The device is also capable of learning the operating parameters necessary to the detection independently and dynamically, which makes it particularly adaptive.

20 Claims, 1 Drawing Sheet

Figure 1:
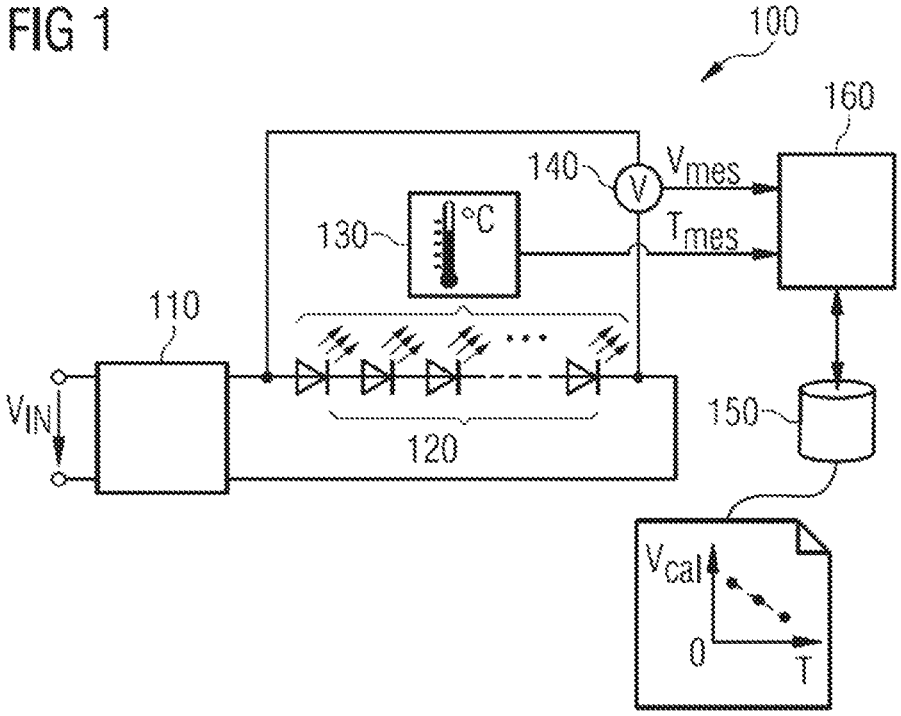

DEVICE AND METHOD FOR DETECTING A SHORT-CIRCUITED LIGHT-EMITTING DIODE IN A LIGHT DEVICE OF A MOTOR VEHICLE

CROSS-REFERENCE TO RELATED APPLICATIONS

This application claims priority to the French application 1553888 filed Apr. 29, 2015, which applications are incorporated herein by reference and made a part hereof.

BACKGROUND OF THE INVENTION

1. Field of the Invention

The invention deals with the field of light devices for motor vehicles, notably light devices which use a plurality of light-emitting diodes, LED, to produce at least one light function of a motor vehicle.

2. Description of the Related Art

A light-emitting diode, LED, is a semiconductor electronic component that emits light when it is passed through by an electrical current of a specific intensity. A property which characterizes an LED is its forward voltage $V_f$. That is the voltage drop measured at the terminals of the LED when the latter is passed through by an electrical current and emits light. The development of increasingly efficient semiconductor components is resulting in the emergence of LEDs that have increasingly lower forward voltages. The forward voltage of an LED is, at an equal current, a decreasing function of its semiconductive junction temperature.

In the motor vehicle industry, and in particular in the field of light devices for motor vehicles, the use of LEDs is increasingly recommended to replace the incandescent light sources traditionally used. This is because the low electrical consumption of LEDs has an undeniable advantage. In addition, a plurality of LEDs can be placed on a predetermined line, thus making it possible to create interesting and individual optical signatures of the lights of a motor vehicle. It is known in practice to use a plurality of LEDs connected in series to produce a light function of a motor vehicle such as, for example, the daytime running lights, direction indicator or high beam function. When the junction of one of the LEDs of such a series assembly is defective, the LED concerned is said to be short-circuited. Headlights of a motor vehicle can be subject to widely varying meteorological conditions. Thus, LEDs forming part of such a headlight need to be able to operate at very low temperatures of the order of −20° C. or less, and at operating temperatures of the device which can exceed 80° C.

It is known practice to detect a short-circuited LED by comparing the voltage at the terminals of the series assembly to an aggregate forward voltage. Such a known solution starts from the principle that if the measured voltage is below $N \cdot V_f$, N being the number of LEDs connected in series and $V_f$ being their forward voltage, then one of the LEDs is short-circuited. With an increasing number of LEDs mounted in series, this method, may, however, in many instances, produce false positive detections. For example, over a temperature range ranging from −40° C. to 90° C., the forward voltage $V_f$ of an LED can exhibit variations of approximately 0.6 V. The minimum forward voltage $V_{fmin}$, at maximum temperature, of the same LED can be equal to approximately 2.3 V. In such a configuration, the voltage at the terminals of a series assembly comprising N LEDs can exhibit variations of N·0.6 V due exclusively to the junction temperature of the LEDs. Clearly, starting from N=6, the amplitude of these variations far exceeds the minimum forward voltage of each of the LEDs of the assembly. Consequently, a short-circuit of an LED may no longer be detected with certainty and the known method is likely to produce false alarms.

The patent document DE 10 2007 024 784 B4 describes a device capable of detecting the short-circuit of an LED in a series assembly. When a failure is detected, an alert signal is notified to the user of the vehicle through the internal information system of the vehicle. The solution described is not capable of taking into consideration the forward voltage variations linked to the junction temperature of the LEDs.

The patent document U.S. Pat. No. 7,638,947 B2 presents a device intended to detect a short-circuit of an LED in a series assembly. According to one embodiment described, the device can be adapted to take into consideration a variation of the forward voltage as a function of the temperature of the LEDs of the series assembly. Nevertheless, the proposed solution requires the presence of dedicated electronic components on the printed circuit board which supports the LEDs. The dedicated components have to be arranged in a specific manner at the terminals of at least one of the LEDs, which generates an increased production cost, an additional constraint in the design of such a printed circuit board, and the potential loss of space on the printed circuit board.

SUMMARY OF THE INVENTION

The aim of the invention is to mitigate at least one of the problems posed by the prior art. More specifically, the aim of the invention is to propose a device and a method that are capable of detecting the short-circuiting of an LED in a series assembly independently of the junction temperatures and using components that are already widely used in the known light devices for motor vehicles.

The subject of the invention is a light device for a motor vehicle. The device comprises driving means for powering a plurality of light-emitting diodes, LEDs, mounted in series. Each of the LEDs is characterized by the same forward voltage $V_f$ dependent on its junction temperature. The device comprises first suitable means for measuring the junction temperature of the LEDs and second means for measuring the electrical voltage at the terminals of the assembly. The device also comprises processing means for detecting a failure of at least one of the LEDs of the assembly. The device is noteworthy in that the processing means are configured to:

- compare the electrical voltage at the terminals of the assembly measured at a first given instant to the electrical voltage at the terminals of the assembly measured at a second given instant, the comparison being conditional on the identity of the junction temperature of the LEDs measured at the first and second instants; and
- detect a failure of at least one of the LEDs of the assembly as a function of this comparison.

For example, the electrical voltage comparison can be done by directly comparing the two voltages, or one of these voltages to a comparison voltage immediately dependent on the other voltage. For example, the comparison voltage can be equal to the other voltage minus a tolerance voltage.

In an equivalent or cumulative manner, the comparison can be conditional on the identity of the currents passing through the LEDs, the currents being measured at the first and second instants.

The device can preferably comprise a memory element, the processing means being configured to read and write in the memory element. The processing means can further be configured to:

obtain, using the measurement means, a measurement $T_{mes}$ indicative of the junction temperature of at least one of the LEDs and a measurement $V_{mes}$ indicative of the electrical voltage at the terminals of the assembly at a given instant when the assembly is powered;

if the memory element contains a voltage value $V_{cal}$ associated with the temperature $T_{mes}$, compare the measurement $V_{mes}$ to $V_{cal}$ or to a comparison voltage directly dependent on $V_{cal}$; and conclude that one of the LEDs of the assembly is short-circuited as a function of the comparison.

If necessary, the measured temperature $T_{mes}$ should be substantially identical to the temperature stored in the memory element.

Preferably, the processing means can be configured to:

if the memory element contains a voltage value $V_{cal}$ associated with the temperature $T_{mes}$, compare the measurement $V_{mes}$ to $(V_{cal}+/-\alpha)$, $0<\alpha\leq V_f$; and conclude that one of the LEDs of the assembly is short-circuited as a function if $V_{mes}<(V_{cal}+/-\alpha)$.

Preferably, the processing means can be configured so as to update the voltage value $V_{cal}$ stored by using the value $V_{mes}$, if $V_{mes}\geq(V_{cal}+/-\alpha)$.

Preferably, the processing means can be configured to:

if the memory element does not contain any voltage value associated with the measurement $T_{mes}$, store the measurement $V_{mes}$ and associate it with the measurement $T_{mes}$ in the memory element.

The first measurement means can preferably comprise a thermistor arranged in proximity to the assembly comprising the plurality of LEDs.

The processing means can preferentially comprise a microcontroller element.

Preferably, the memory element can be incorporated in the microcontroller element.

The microcontroller element can preferably form part of the driving means for powering the LEDs.

Preferably, the assembly and the first measurement means are arranged on the same substrate. It can for example be the substrate of a printed circuit board, PCB, or of a molded interconnect device, MID.

Another subject of the invention is a method for detecting a short-circuited light-emitting diode, LED, in a light device for a motor vehicle. The device comprises driving means for powering a plurality of light-emitting diodes, LED, mounted in series. Each of the LEDs is characterized by the same forward voltage $V_f$ dependent on its junction temperature. The device also comprises first means for measuring the junction temperature of the LEDs and second means of the electrical voltage at the terminals of the assembly. The device comprises processing means for detecting a failure of at least one of the LEDs of the assembly. The method is noteworthy in that it comprises the following steps:

comparing the electrical voltage at the terminals of the assembly measured at a first given instant to the electrical voltage at the terminals of the assembly measured at a second given instant, the comparison being conditional on the identity of the junction temperature of the LEDs measured at the first and second instants; and detecting a failure of at least one of the LEDs of the assembly as a function of this comparison.

Preferably, the method can comprise the following steps:

obtaining, using the measurement means, a measurement $T_{mes}$ indicative of the junction temperature of at least one of the LEDs and a measurement $V_{mes}$ indicative of the electrical voltage at the terminals of the assembly at a given instant when the assembly is powered.

Preferably, the method can comprise the following steps:

if the memory element contains a voltage value $V_{cal}$ associated with the temperature $T_{mes}$, comparing the measurement $V_{mes}$ to $V_{cal}$ or to a comparison voltage directly dependent on $V_{cal}$; and concluding that one of the LEDs of the assembly is short-circuited as a function of the comparison.

Preferably, the method can comprise the following steps:

if the memory element contains a voltage value $V_{cal}$ associated with the temperature $T_{mes}$, comparing the measurement $V_{mes}$ to $(V_{cal}+/-\alpha)$, $0<\alpha\leq Vf$; and concluding that one of the LEDs of the assembly is short-circuited if $V_{mes}<(V_{cal}+/-\alpha)$.

Preferably, the method can comprise the following steps:

if the memory element does not contain any voltage value associated with the measurement $T_{mes}$, storing the measurement $V_{mes}$ and associating it with the measurement $T_{mes}$ in the memory element.

The method can preferably further comprise a step of updating the voltage value $V_{cal}$ stored and associated with the measurement $T_{mes}$ by using the value $V_{mes}$, if $V_{mes}\geq(V_{cal}+/-\alpha)$.

The method can preferably comprise an intermediate step of filtering of the measurements following the step of obtaining of the measurements. During this step, measurements not belonging to a predetermined range are discarded. The predetermined measurement range for the measurement $T_{mes}$ can preferably comprise the values between −40° C. and 90° C.

Preferably, the predetermined range of measurements for the measurement $V_{mes}$ can comprise the values between 0 V and N $V_{fmax}$, N being the number of LEDs of the assembly and $V_{fmax}$ being the forward voltage of one of the LEDs of the assembly at −40° C.

The steps of the method can preferably be repeated periodically. The repetition period can for example have a duration of between 2 seconds and 10 minutes, preferably between 2 and 30 seconds.

The steps of the method can preferably be implemented if the junction temperature of the LEDs and the electrical voltage at the terminals of the assembly have generally constant values.

During the updating step, the voltage value $V_{cal}$ associated with the measurement $T_{mes}$ can preferentially be replaced by a weighted average of the associated voltage value and of the measured voltage value $V_{mes}$.

During the storage step, the measured voltage value $V_{mes}$ can preferably be replaced by a weighted average of the value $V_{mes}$ and of at least one associated voltage value in the memory element at a temperature lying within the range $[T_{mes}-\beta, T_{mes}+\beta]$, $\beta$ lying between 0.1 and 30° C.

Preferably, the method can also comprise a preliminary step of provision of initial voltage values associated with a plurality of temperature values in the memory element.

Advantageously, the method is implemented by a light device according to the invention.

By using the measurements according to the invention, it becomes possible to detect the short-circuiting of an LED in a series assembly of a plurality of LEDs, independently of the junction temperature of the LEDs while significantly reducing the risk of false positive detections. It is standard practice to include thermistors on a printed circuit board comprising an assembly of LEDs, in order to be able to detect very high temperatures likely to damage the LEDs. Similarly, the voltage at the terminals of such an assembly is commonly measured and used to control the driving device for powering the assembly. The new functionality according to the invention can therefore be produced without components and therefore without additional costs compared to the known light devices, by using the measurements made available in a previously unknown manner. Since the calibration of the device is done automatically, there is no need to calibrate the device during its production. The dynamic learning of the characteristic $V_f(T)$ over the lifetime of the device adapts the device to the conditions in which the motor vehicle which is equipped with it actually moves, without having to make recourse to hypothetical and potentially erroneous operation temperature hypotheses.

These and other objects and advantages of the invention will be apparent from the following description, the accompanying drawings and the appended claims.

BRIEF DESCRIPTION OF THE ACCOMPANYING DRAWINGS

Figure 2:
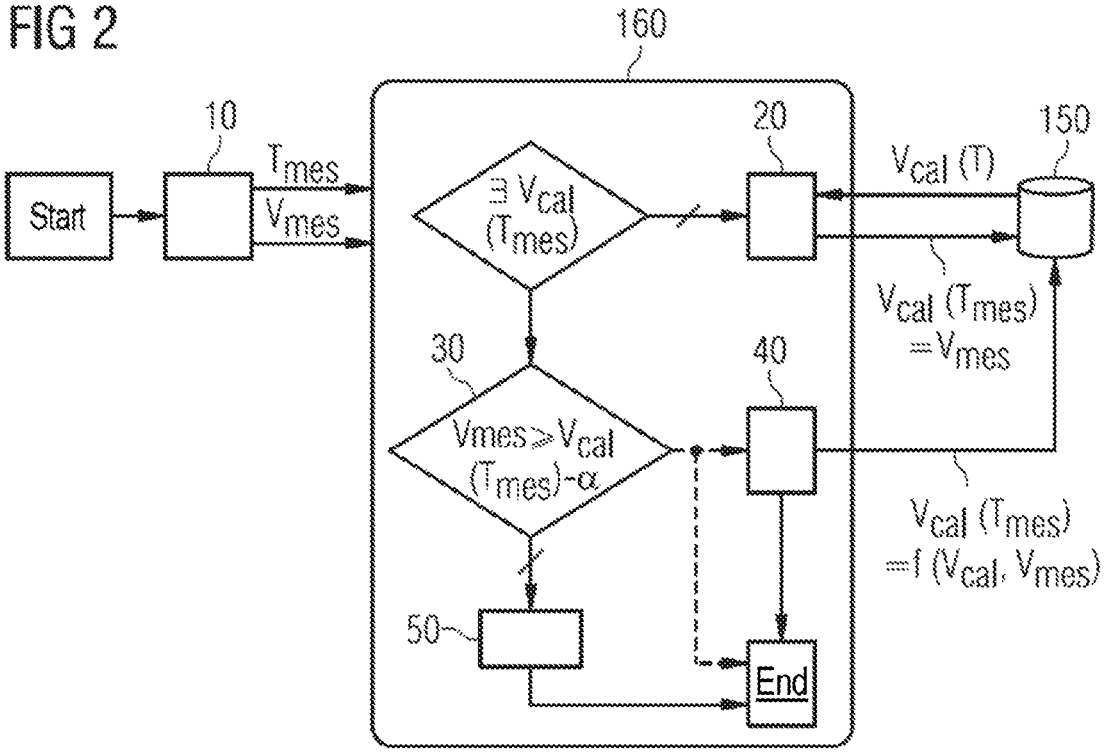

Other features and advantages of the present invention will be better understood from the exemplary description and the drawings in which:

FIG. 1 is a schematic illustration of a preferred embodiment of the device according to the invention; and FIG. 2 is a schematic illustration of the processing means of FIG. 1, illustrating also the main steps of a preferred embodiment of the method according to the invention.

DETAILED DESCRIPTION OF THE PREFERRED EMBODIMENTS

Unless specifically indicated otherwise, technical features described in detail for a given embodiment can be combined with the technical features described in the context of other embodiments described in exemplary and non-limiting manner.

Various components necessary to the operation of a light device for a motor vehicle, which nevertheless have no impact on the operation of the invention, will not be described in the context of the invention and are in themselves known in the art. They are for example heat dissipation means or optical means such as lenses or waveguides.

FIG. 1 schematically shows a preferred embodiment of the light device 100 according to the invention. A plurality of light-emitting diodes, LEDs, is powered through a supply driving means 110. Such supply driving means 110 are known per se in the art and comprise at least one converter capable of DC input voltage $V_{in}$, generally supplied by a battery of the motor vehicle, into a charging voltage of a different value suitable for powering the assembly 120.

The LEDs which together produce at least one light function of the light device, are mounted in series and grouped together in the assembly 120. The LEDs are generally mounted on a dedicated printed circuit board, PCB, at a distance from the supply driving means 110. The assembly 120 can also be arranged on a molded interconnect device, MID, of more complex geometry. The supply driving means 110 can for example comprise a microcontroller element suitable for controlling the charging voltage as a function of the required light function.

The light device 100 comprises first measurement means 130, suitable for supplying a signal indicative of the junction temperature of the LEDs. This is, for example, a thermistor mounted on the printed circuit board which supports the assembly 120. The temperature of the printed circuit board can realistically be likened to the junction temperature of an LED mounted on the printed circuit board. Since the resistance of a thermistor decreases according to a predetermined profile when its temperature increases, a signal indicative of the temperature of the printed circuit board, and therefore of the semiconductive junction of the LEDs, can be obtained by measuring the electrical voltage at the terminals of the thermistor. Such measurement circuits are per se known in the art and will not be described in more detail in the context of the present invention. Other means for measuring the temperature of the printed circuit board and/or the junction temperature of the LEDs can be implemented by those skilled in the art without in any way departing from the scope of the invention.

The light device 100 also comprises second measurement means 140 suitable for supplying a signal indicative of the electrical voltage at the terminals of the assembly 120. First and second measurement means 130, 140 provide real-time measurement to processing means 160. The processing means 160 can for example comprise a programmable microprocessor element or a microcontroller element. Advantageously, it can be a microcontroller element of the supply driving means 110 for powering the assembly 120. The processing means 160 have write and read access to a non-volatile memory element 150. Such memory elements 150 are well known in the art and can be incorporated in the processing means 160.

The processing means 160 comprise, also in a non-volatile memory element 150, instructions which, when they are executed, cause the supply driving means 160 to perform different steps according to the inventive method. By using as input a temperature measurement $T_{mes}$ and a voltage value $V_{mes}$ supplied by the first and second measurement means 130 and 140 respectively, the processing means 160 are able to detect whether one of the LEDs of the assembly 120 is short-circuited or not. At the same time, the processing means 160 construct, by learning following a series of measurements, a profile in the memory element 150. The profile correlates the measured voltages with the temperatures for which they have been measured. This profile serves as a reference in the detection of a short-circuit. In effect, when the N LEDs of the assembly 120 are operating, the voltage measured at the terminals of the assembly is equal to $V_{mes}=N\cdot V_f(T_{mes})$. Obviously, such a profile corresponds to a specific light function. If the LEDs of the assembly 120 can produce a number of light functions with different applied current intensities, the specific mode of operation defines the profile to be used in the method. Thus, the memory element 150 may contain a plurality of profiles in certain embodiments. Since the processing means 160 are preferably incorporated in the supply driving means 110 which determine the voltage applied to the LEDs, the information necessary to make the correct choice of profile is available.

In the text which follows, the method according to the invention and the operation of the processing means 160 will be described in detail. The processing means 160 are configured to compare the electrical voltage at the terminals of the assembly 120 of LEDs, measured at a first given instant, to the electrical voltage at the terminals of the assembly 120 measured at a second given instant, the comparison being conditional on the identity of the junction temperature of the LEDs measured at the first and second instants. Further-more, the processing means 160 are configured to detect a failure of at least one of the LEDs of the assembly 120 as a function of this comparison.

FIG. 2 illustrates the main steps of the method according to the invention in a preferred embodiment. In a first step 10, the values $T_{mes}$ and $V_{mes}$ are obtained by the processing means 160. The memory element 150 is consulted in order to establish whether a voltage value has already been associated with the measured temperature. If such is the case, the duly found voltage value $V_{cal}$ is used as reference value to which the measured value $V_{mes}$ is compared in the step 30.

The value $V_{cal}$ represents the aggregate forward voltage of the N LEDs, $N \cdot V_f(T_{mes})$, at the temperature $T_{mes}$. It follows therefrom that, when the measured voltage $V_{mes}$ is lower than $(V_{mes}+/-\alpha)$, the method can conclude that one of the LEDs of the assembly 120 is short-circuited. This corresponds to the step 50.

The parameter a defines a threshold value for the detection of a short-circuit. In practice, an $\alpha$ value is used that lies between 0 and the minimum value that the forward voltage of one of the LEDs of the assembly 120 can take. If $V_{fmin}$ is the forward voltage of an LED at 90° C., then it is possible, for example to set $\alpha=0.8 \cdot V_{fmin}$.

Alternatively, the method can directly store the adjusted values $V_{cal}-\alpha$ in the memory element 150, which allows for the direct comparison between the voltage value $V_{mes}$ and the stored reference voltage value associated with the temperature $T_{mes}$.

Advantageously, the processing means 160 are configured to emit an alarm signal and to notify the latter to the user of the vehicle when a short-circuit is detected. Alarm means are not illustrated in the figures and are in themselves known in the prior art.

If the memory element 150 does not contain any voltage value associated with the measured temperature $T_{mes}$, identical to the measured temperature, a new value $V_{cal}(T_{mes})=V_{mes}$ is written and stored in the memory element 150 and thus complements the stored profile.

When, at the end of the comparison step 30, it is found that the measured voltage $V_{mes}$ is higher than or equal to the corresponding threshold value $(V_{mes}+/-\alpha)$, the method concludes that all the LEDs are operating correctly, and that none of the LEDs is short-circuited. Optionally, the measured value can be used to refine or update the voltage value $V_{cal}(T_{mes})$ in the memory element 150. For example, a weighted average of the voltage value previously associated with the temperature $T_{mes}$ and of the measured voltage value can replace the voltage value previously associated with this temperature.

In all the embodiments of the method according to the invention, a number of additional steps described herein below can be considered. In order to avoid the use of erroneous measurements, the values obtained in the step 10 can be checked or filtered before they are used in the subsequent steps. For example, in a filtering step 40, measurements that do not belong to a predetermined range are discarded. The predetermined measurement range for the measurement $T_{mes}$ comprises, for example, the values between −40° C. and 90° C. The predetermined range of measurements for the measurement $V_{mes}$ comprises, for example, the values between 0 Volt and $N \cdot V_{fmax}$ Volt, N being the number of LEDs of the assembly and $V_{fmax}$ being the forward voltage of one of the LEDs of the assembly at −40° C.

The method is preferably repeated periodically. This makes it possible on the one hand to ensure that the correct operation of the LEDs is checked regularly, and on the other hand that new values are learned and the profile stored in the memory element 150 is regularly updated. In order to obtain representative values, it is important to check that the measured temperature and voltage are in a stable state when the measurements are taken. Following significant variations of temperature or of voltage, a stable state is in practice obtained after a few seconds. This is why the method is preferably repeated periodically every 2 to 30 seconds. It can also be repeated periodically after several minutes. Alternatively, the light device 100 according to the invention comprises detection means suitable for identifying whether the values measured by the first and second measurement means 130 and 140 are in a stable state. The method can then be implemented only if a stable state is determined. A stable state should be understood to mean a state in which measurements are maintained at generally constant values for a predefined time period of 1 to 10 seconds.

In one embodiment according to the invention, in the step 20 of storage of the measured voltage value $V_{mes}$, the latter is replaced by a weighted average of the value $V_{mes}$ and of at least one associated voltage value in the memory element 150 with a similar temperature lying within the range $[T_{mes}-\beta, T_{mes}+\beta]$, $\beta$ lying between 0.1 and 10° C. This makes it possible to interpolate intermediate values.

In all the embodiments, the method can comprise a preliminary step of provision of initial voltage values associated with a plurality of temperature values in the memory element 150. This initial profile is then updated by the steps of the method throughout the life of the light device 100.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A light device for a motor vehicle, said light device comprising;

driving means for powering a plurality of light-emitting diodes, LEDs, mounted in series, each of said LEDs being characterized by the same forward voltage $V_f$ dependent on its junction temperature;

first means for measuring said junction temperature of said LEDs;

second means for measuring an electrical voltage at the terminals of an assembly; and processing means for detecting a failure of at least one of said LEDs of said assembly;

wherein said processing means are configured to:

compare said electrical voltage at said terminals of said assembly measured at a first given instant to said electrical voltage at said terminals of said assembly measured at a second given instant, said comparison being conditional on the identity of said junction temperature of said LEDs measured at said first and second instants; and detect a failure of at least one of said LEDs of said assembly as a function of said comparison.

2. The light device according to claim 1, wherein the light device comprises a memory element, said processing means being configured to read and write in said memory element and being configured to:

obtain, using said measurement means, a measurement $T_{mes}$ indicative of said junction temperature of at least one of said LEDs and a measurement $V_{mes}$ indicative of said electrical voltage at said terminals of said assembly at a given instant when said assembly is powered.

3. The light device according to claim 2, wherein said processing means are further configured to:

if said memory element contains a voltage value $V_{cal}$ associated with said measurement $T_{mes}$, compare said measurement $V_{mes}$ to said voltage value $V_{cal}$ or to a comparison voltage directly dependent on said voltage value $V_{cal}$; and conclude that one of said LEDs of said assembly is short-circuited as a function of said comparison.

4. The light device according to claim 3, wherein said processing means are configured to:

if said memory element contains said voltage value $V_{cal}$ associated with said measurement $T_{mes}$, compare said measurement $V_{mes}$ to $(V_{cal}+/-\alpha)$, $0<\alpha\leq V_f$ conclude that one of said LEDs of said assembly is short-circuited if $V_{mes}<(V_{cal}+/-\alpha)$.

5. The light device according to claim 2, wherein said processing means are further configured to:

if said memory element does not contain any said voltage value associated with said measurement $T_{mes}$, store said measurement $V_{mes}$ and associate said measurement $V_{mes}$ with said measurement $T_{mes}$ in said memory element.

6. The light device according to claim 2, wherein said processing means are further configured to update said voltage value $V_{cal}$ stored by using said measurement $V_{mes}$, if $V_{mes}\geq(V_{cal}+/-\alpha)$.

7. A method for detecting a short-circuited light-emitting diode, LED, in a light device for a motor vehicle, said light device comprising:

driving means for powering a plurality of light-emitting diodes, LED, mounted in series, each of said LEDs being characterized by the same forward voltage $V_f$ dependent on its junction temperature;

first means for measuring said junction temperature of said LEDs;

second means for measuring an electrical voltage at the terminals of an assembly;

processing means for detecting a failure of at least one of said LEDs of said assembly, wherein said method comprises the following steps:

comparing said electrical voltage at said terminals of said assembly measured at a first given instant to said electrical voltage at said terminals of said assembly measured at a second given instant, said comparison being conditional on the identity of said junction temperature of said LEDs measured at said first and second instants; and detecting a failure of at least one of said LEDs of said assembly as a function of said comparison.

8. The method according to claim 7, wherein said method comprises the following steps:

obtaining, using said measurement means, a measurement $T_{mes}$ indicative of said junction temperature of at least one of said LEDs and a measurement $V_{mes}$ indicative of said electrical voltage at said terminals of said assembly at a given instant when said assembly is powered.

9. The method according to claim 8, wherein said method comprises the following steps:

if a memory element of said light device contains a voltage value $V_{cal}$ associated with said measurement $T_{mes}$, comparing said measurement $V_{mes}$ to said voltage value $V_{cal}$ or to a comparison voltage directly dependent on said voltage value $V_{cal}$;

concluding that one of LEDs of said LEDs of assembly is short-circuited as a function of said comparison.

10. The method according to claim 9, wherein said method comprises the following steps:

if said memory element contains said voltage value $V_{cal}$ associated with said measurement $T_{mes}$, comparing said measurement $V_{mes}$ to $(V_{cal}+/-\alpha)$, $0<\alpha\leq V_f$;

concluding that one of said LEDs of said assembly is short-circuited if $V_{mes}<(V_{cal}+/-\alpha)$.

11. The method according to claim 8, wherein said method comprises the following steps:

if said memory element does not contain any said voltage value associated with said measurement $T_{mes}$, storing said measurement $V_{mes}$ and associating said measurement $V_{mes}$ with said measurement $T_{mes}$ in said memory element.

12. The method according to claim 8, wherein said method further comprises the step of updating said voltage value $V_{cal}$ stored and associated with said measurement $T_{mes}$ by using said measurement $V_{mes}$, if $V_{mes}\geq(V_{cal}+/-\alpha)$.

13. The method according to claim 8, wherein said method comprises an intermediate step of filtering of said measurements following said obtaining step, during which measurements not belonging to a predetermined range are discarded.

14. The method according to claim 8, wherein said steps are repeated periodically.

15. The method according to claim 8, wherein said steps are implemented if said junction temperature of said LEDs and said electrical voltage at said terminals of said assembly have generally constant values.

16. The method according to claim 7, wherein said method comprises a preliminary step of the provision of initial voltage values associated with a plurality of temperature values in said memory element.

17. The light device according to claim 3, wherein said processing means are further configured to:

if said memory element does not contain any said voltage value associated with said measurement $T_{mes}$, store said measurement $V_{mes}$ and associate said measurement $V_{mes}$ with said measurement $T_{mes}$ in said memory element.

18. The light device according to claim 4, wherein said processing means are further configured to:

if said memory element does not contain any said voltage value associated with said measurement $T_{mes}$, store said measurement $V_{mes}$ and associate said measurement $V_{mes}$ with said measurement $T_{mes}$ in said memory element.

19. The light device according to claim 3, wherein said processing means are further configured to updatesaid voltage value $V_{cal}$ stored by using said measurement $V_{mes}$, if $V_{mes}\geq(V_{cal}+/-\alpha)$.

20. The light device according to claim 4, wherein said processing means are further configured to updatesaid voltage value $V_{cal}$ stored by using said measurement $V_{mes}$, if $V_{mes}\geq(V_{cal}+/-\alpha)$.

* * * * *